United States Patent [19]

Dahl

[11] 3,966,050

[45] June 29, 1976

[54] INDEX FILE

[76] Inventor: Robert M. Dahl, 633 Park St., Wilmette, Ill. 60091

[22] Filed: Mar. 31, 1975

[21] Appl. No.: 563,786

[52] U.S. Cl. ..... 211/10; 108/102; 108/143

[51] Int. Cl.[2] ..... A47B 57/00

[58] Field of Search ..... 211/10, 11, 184; 248/430, 429, 424; 108/102, 143

[56] References Cited

UNITED STATES PATENTS

| | | | |
|---|---|---|---|
| 1,838,199 | 12/1931 | Thomas | 248/429 |
| 1,931,785 | 10/1933 | Wright | 211/11 |
| 2,201,227 | 5/1940 | Casey | 211/10 |
| 2,233,094 | 2/1941 | Casey | 211/10 |
| 2,294,194 | 8/1942 | Metzger | 211/11 |
| 2,553,652 | 5/1951 | Gradle et al. | 248/430 |
| 3,126,892 | 3/1964 | French | 211/184 X |
| 3,127,022 | 3/1964 | French | 211/184 |
| 3,487,945 | 1/1970 | Barham | 211/184 X |
| 3,789,779 | 2/1974 | Guest et al. | 108/102 X |

*Primary Examiner*—Roy D. Frazier
*Assistant Examiner*—Robert W. Gibson, Jr.
*Attorney, Agent, or Firm*—Olson, Trexler, Wolters, Bushnell & Fosse, Ltd.

[57] ABSTRACT

The structure of the present invention comprises an index file in the form of a shiftable table longitudinally operable upon a support base. The table is shiftable upon antifriction means, and may be releasably locked in position. Means is provided for sectionalizing the index cards or data folders carried by the table to maximize accessibility and minimize operator fatigue.

7 Claims, 13 Drawing Figures

Fig. 6
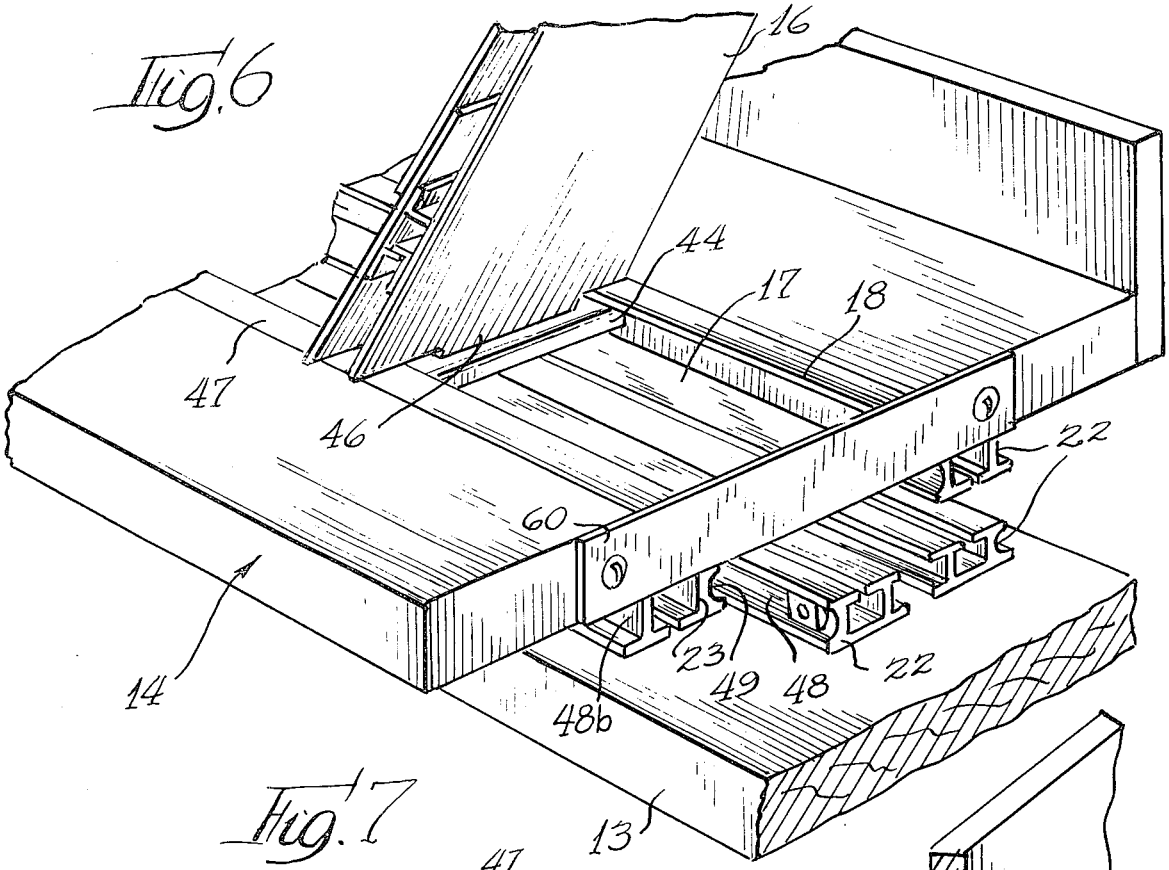
Fig. 7
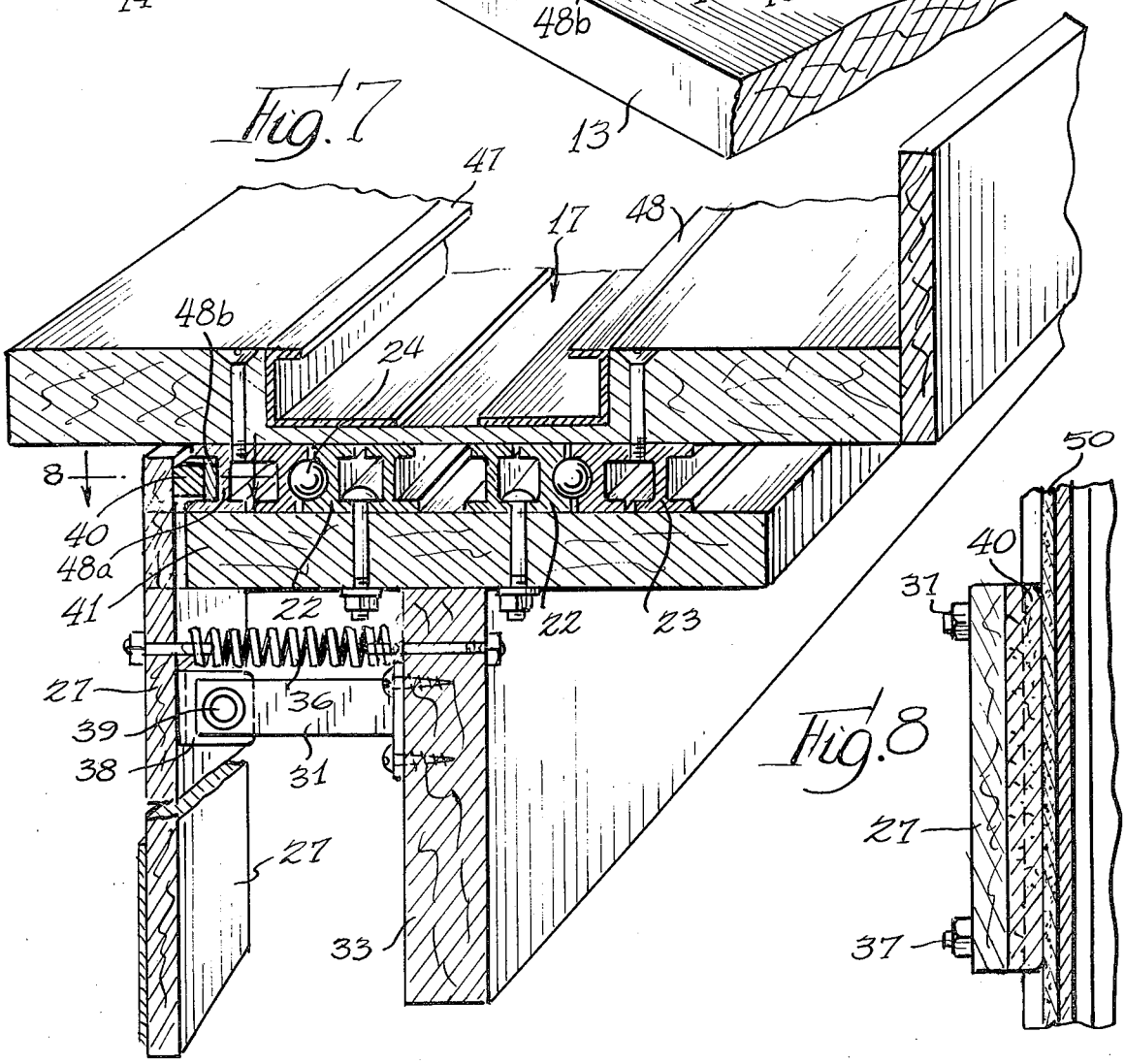
Fig. 8

51
50
53
16
54
52
57
56
17
62
44
46
48
60
22
59
24
81
82
80
84
83
68
69
45
65
66
67
64
77
74
71
70
78
72
76

INDEX FILE

BACKGROUND OF THE INVENTION AND OBJECTS

This invention relates to index files, and concerns more particularly index files of the shiftable table type.

The present invention provides an index file, of the shiftable table type, wherein one or more files may be suitably arranged for operation by a single operator. Each file provides a shiftable table, arranged to carry file cards or other file data, shiftable upon antifriction means, and arranged to be releasably locked in position. Means is provided for sectionalizing the file data, for further accessibility, and to minimize operator fatigue.

It is an object of the invention to provide an index file of the shiftable or adjustable type, for ready access to the file data contained, which may be readily fabricated, at low cost and which is sturdy both laterally and longitudinally, in all positions of adjustment.

A further object of the invention is to provide a shiftable index file, of the type set forth, which may be readily adapted to various sizes, and which is arranged to minimize operator fatigue.

A further object of the invention is to provide a shiftable or adjustable index file, of the type set forth, which may be easily shifted to its various positions of adjustment, and yet may be releasably locked in position for more ready manipulation of the files contained.

A still further object of the invention is to provide a shiftable or adjustable index file, of the type set forth, which may be readily sectionalized for further ease of manipulation of the files contained.

Various other objects, advantages and features of the invention will be apparent from the following specification, when taken in connection with the accompanying drawings, wherein a preferred embodiment of the invention is set forth for purposes of illustration.

BRIEF DESCRIPTION OF THE DRAWINGS

FIG. 6 is a fragmentary perspective view showing the cooperation of the shiftable table and support base;

FIG. 7 is a sectional view taken along line 7—7 of FIG. 3;

FIG. 8 is a sectional view taken along line 8—8 of FIG. 7;

DETAILED DESCRIPTION OF THE ILLUSTRATED EMBODIMENT

Figure 1:
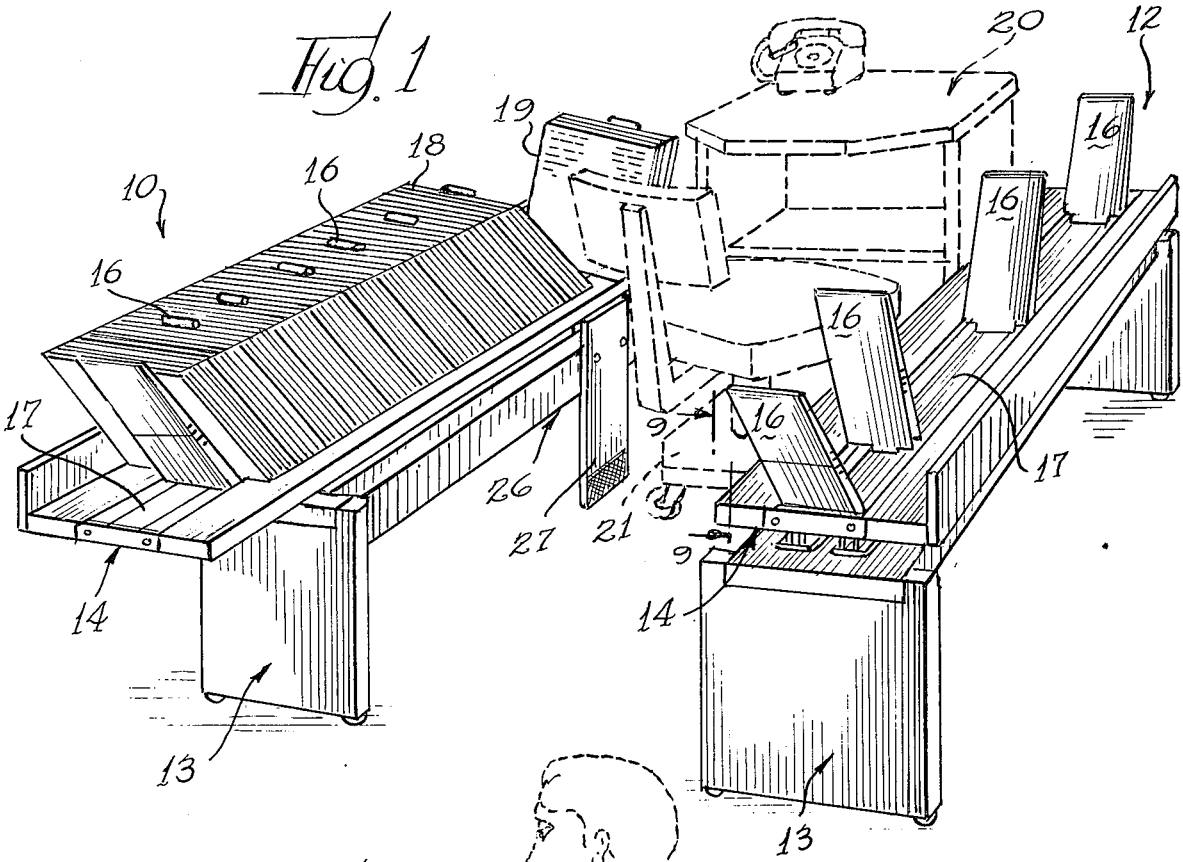
FIG. 1 is a perspective view showing a pair of index files constructed in accordance with this invention.

Referring now to FIG. 1, there is seen a pair of index files which are constructed in accordance with the principles of this invention and designated generally by reference numerals 10 and 12. The index file 10 is shown with files in position while the index file 12 is shown empty. The index files 10 and 12 are substantially identical in construction. Therefore, reference numerals relating to the details will apply equally to either one of the index file units. The index files 10 and 12 are provided with support bases 13 upon which is positioned a selectively shiftable table assembly 14. A plurality of index file supports or divider means 16 are provided along the table and are movable within a channel 17 to adjust the spacing therebetween. The index file 10 supports a plurality of index cards designated generally by reference numeral 18. The index cards 18 can be opened as shown in FIG. 1 by reference numeral 19. The dividers 16 are readily tiltable along the longitudinal axis of the file table to allow an operator to have easy access to the cards filed in the units. Preferably, the card files are spaced apart to accommodate a table and chair 20 and 21, respectively, so that an operator can perform various tasks in a convenient and efficient manner.

Figure 2:
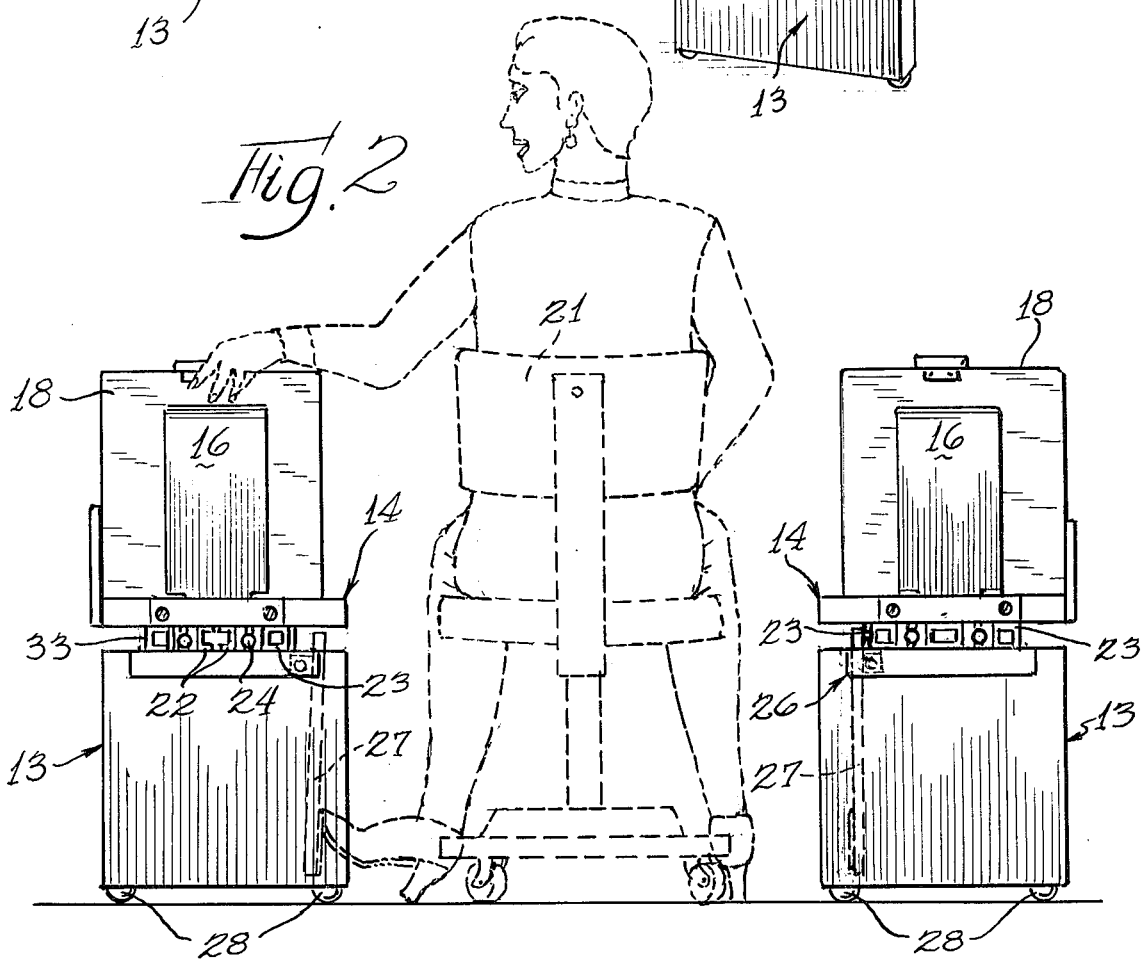
FIG. 2 is an end view of the index file structures illustrated herein with a user shown in phantom line seated therebetween.
Figure 3:
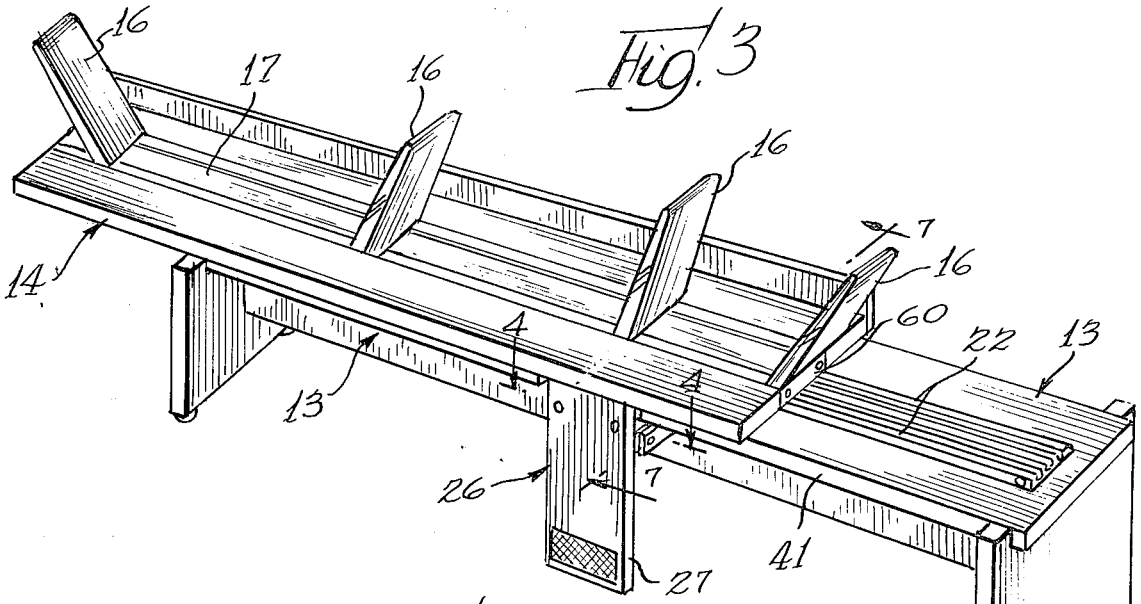
FIG. 3 is a perspective view of the index file structure of this invention.

The table 14 is shiftable longitudinally upon the base 13 by means of complementary rail elements 22 and 23 cooperable with one another and adapted to capture ball bearing rollers 24 therebetween, as best seen in FIGS. 6 and 7. To prevent the shiftable table 14 from inadvertently moving axially along the base 13, a brake structure 26 is provided. This brake structure includes a foot operated lever 27 to be released when shifting the table is desired, as best seen in FIG. 2. The index files may be provided with rollers 28 at the bottom portion of the base 13 to facilitate moving the files from one location to another. FIG. 3 illustrates the index file with the shiftable table 14 moved to a forward position and exposing the complementary rails 22 secured to the base 13. It can be seen that the dividers 16 are readily tiltable in either direction.

Figure 4:
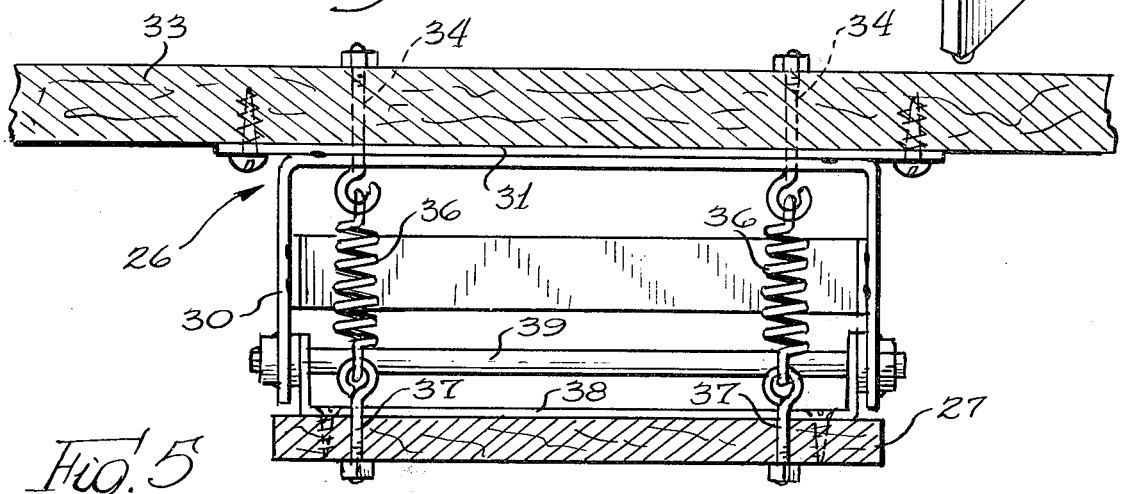
FIG. 4 is a sectional view taken along line 4—4 illustrating the operation and construction of the brake assembly of the index file of this invention.

Referring now to FIG. 4, there is seen a sectional view taken along line 4—4 of FIG. 3 which illustrates the details of construction of the brake arrangement 26. Here, the brake lever 27 is pivotally secured to a U-shaped bracket 30 which, in turn, may be spot-welded or otherwise secured to a mounting plate 31. The mounting plate 31 is fastened to a depending web section 33 secured to the underside of the base structure 13. A pair of eyebolts 34 are provided to receive springs 36 which, in turn, are secured to a second pair of eyebolts 37 extending through the foot operated lever 27. A second U-shaped bracket 38 is secured to the operating lever 27 and is pivotally mounted to U-shaped bracket 30 by means of a rod 39. Therefore, the entire foot operated lever 27 will pivot about the rod when depressed as shown in FIG. 2. When depressing the lever a friction pad 40 will disengage from the edge 41 of the base assembly 13, as best seen in FIGS. 7 and 8. This will enable the entire table structure 14 to be moved forwardly and rearwardly along the rails while the brake assembly 26 remains in a fixed position on the base structure.

Figure 5:
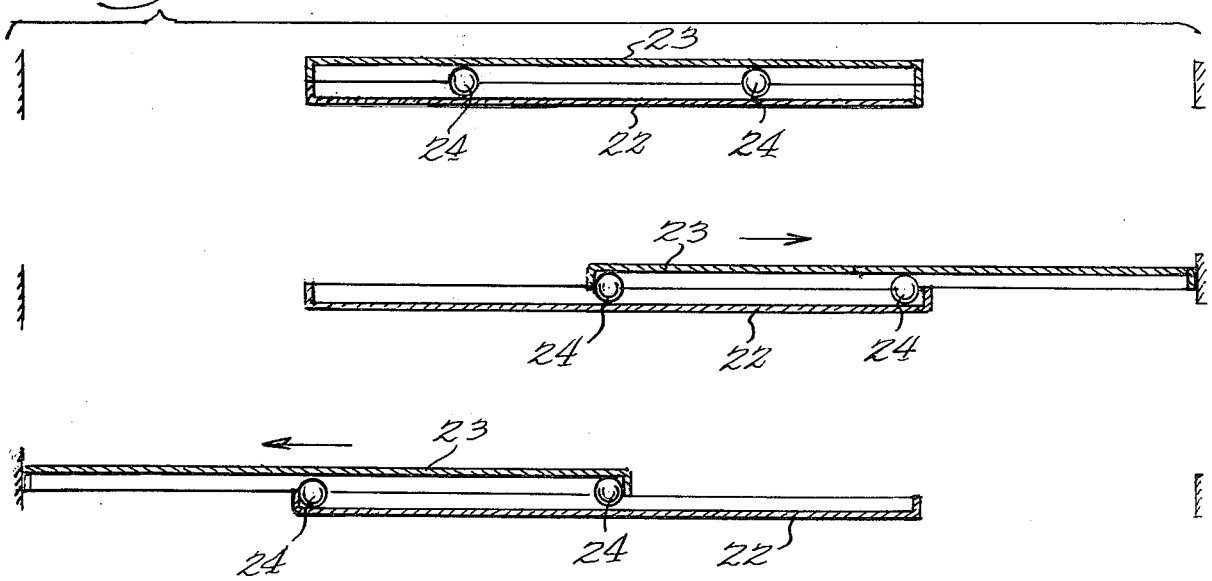
FIG. 5 is a series of diagrammatic illustrations showing the operation between complementary rail means associated with the index file structure of this invention.

FIG. 5 illustrates the operation of the cooperable and complementary rails 22 and 23. The balls 24 are captured between the rails 22 and 23 at a point approximately one quarter the distance from each end. When the top rail 23 moves to the right as shown by the middle of FIG. 5, the balls will travel half the distance of the top rail. Similarly, when the top rail is moved to the left as shown by the bottom of FIG. 5, the balls move half the distance. Therefore, the movable table 14 is easily shifted from one position to another with a minimum of effort on the part of the operator.

Figures 9, 10, 11, 12, 13:
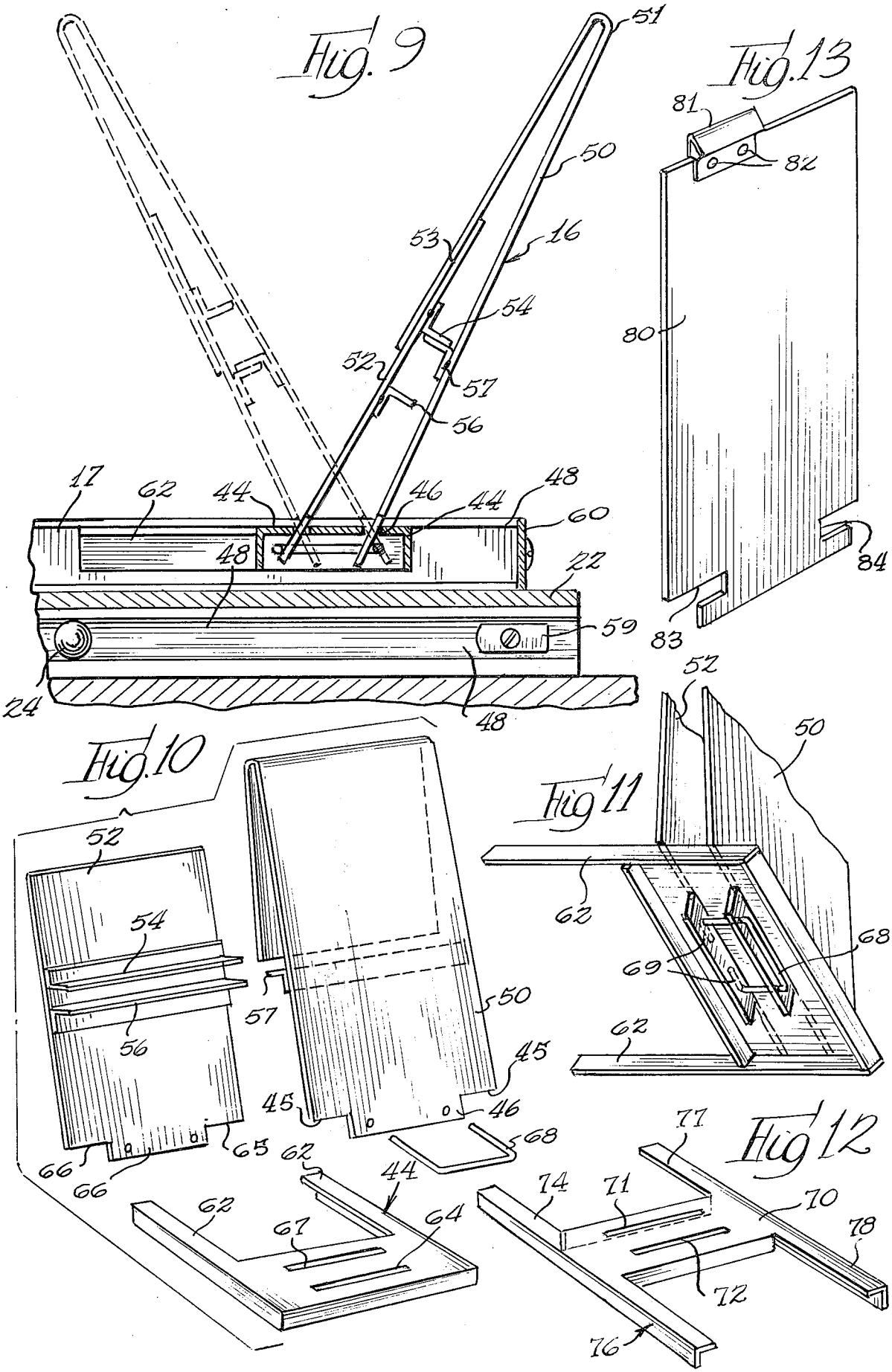
FIG. 9 is a fragmentary side view of the construction of the divider units of this invention.
FIG. 10 is an exploded view illustrating the various components of the divider units of this invention.
FIG. 11 is a fragmentary view showing the bottom of the divider unit in an assembled condition with its slide element.
FIG. 12 illustrates an alternate configuration of the slide elements which can be used with the divider unit of FIGS. 9, 10 and 11.
FIG. 13 illustrates still another alternate embodiment of a divider which can be used in accordance with the principles of this invention.

FIG. 6 illustrates a fragmentary perspective portion of the base assembly 13 and the movable table 14. Here, the channel 17 is clearly illustrated with the divider 16 slidably secured therein. The bottom of the divider 16 has a cross plate slide member 44 which receives end tabs 46 and 66 associated with each of the dividers. This is best illustrated in FIGS. 10 and 11. When the divider 16 is tilted as illustrated in FIG. 6, the shoulder portions 45 and 65 engage the top of the channel 17 and cause the member 44 to be pulled upwardly within the channel and engages the bottom of radially inwardly directed rail members 47 and 48. Therefore, the divider is held firmly in position without sliding along the channel. When the divider is moved to a somewhat vertical position, the cross member 44 is released from firm engagement with the underside of the rails 47 and 48 and the divider can be slid therealong. The pad element 40 engages the element 48*a* secured to the table 14. The pad 40 and/or the linear element 50 may be made of brake friction material. The element 48*a* is secured in a channel 48*b* located on the opposite side of the channel 49.

It will be noted in FIG. 7 that the complementary rail members 22 and 23 have their vertically disposed flange portions staggered relative to one another so that the ball 24 is captured therein. Also seen in FIG. 7 is that the channel 17 is formed by a pair of similarly fashioned extrusions substantially J-shaped in the cross section and positioned within the movable table to provide rails upon which the dividers 16 slide. FIGS. 6, 7 and 9 illustrate the complementary rails 20 and 22 as capturing the roller balls 24 between side grooves or channels 48 and 49. It will be understood that the channels can be vertically disposed one above the other rather than side by side as illustrated herein.

FIGS. 9, 10, 11 and 12 illustrate the details of construction of the dividers 16. The dividers 16 are formed of a first sheet metal member 50 having a bight portion 51 formed at the top thereof and turned downwardly toward the channel 17. A second plate member 52 is provided and there is a sliding contact surface area 53 between the number 52 and the inside portion of the downwardly turned plate member 50. A pair of abutment elements 54 and 56 are secured to the inside of the plate 52 and a third abutment element 57 is secured to the inside of the sheet metal member 50. The element 57 engages the bottom portion of the abutment member 54 when the dividers 16 are in the position shown in solid lines. However, the abutment member 57 engages the abutment member 56 when the dividers 16 are moved to the opposite angular position as shown in broken lines. The rail members 22 have stop elements 59 secured in the channel 48 to prevent the balls from dislodging. Stop elements, not shown, are also provided within the channel of the rail members 23. The channel 17 is provided with end caps 60 and 61 secured by screws or other suitable fasteners to prevent the dividers from slipping out.

As seen in the drawings, the slide member 44 has elements 62 which extend a substantial distance along the length of the channel 17 to prevent cocking thereof and thereby providing smooth sliding operation. The tab 46 is inserted into a slot 64 while a second tab 66 is inserted into a slot 67 in the slide member 44. A U-shaped crip 68 is inserted through apertures formed in the tabs 46 and 66 to lock the divider member in position in the sliding element by turning over the end portions 69 thereof, as best seen in FIG. 11. This enables the two members 50 and 52 to pivot relative to the slide member 44 and allow the plate portions 52 and the downwardly directed portion of plate 50 to slide relative to one another. In the alternative, FIG. 12 illustrates a slide element 70 which has slots 71 and 72 formed therein to receive the tabs 66 and 46. However, the slide element 70 has oppositely directed rail portions 74 and 76 on one side thereof and opposite the directed rail portion 77 and 78 on the other side thereof.

FIG. 13 illustrates an alternate embodiment of a divider which can be used in accordance with this invention. Here a divider element 80 is provided by means of a single sheet having a tab 81 secured at the top thereof by rivets or screws 82. The bottom of the divider 80 is provided with notches 83 and 84 which are intended to overlie the radially inwardly directed flanges 47 and 48 of the channel 17. The amount of tilt that the divider 80 will achieve is determined by the width of the notches. Furthermore, the edges of the material forming the notches will prevent inadvertent sliding of the divider when it is angled to the extreme positions as shown in FIG. 9.

What has been described is a simple and efficient means for providing an index file arrangement. It will be understood that variations and modifications may be effective without departing from the spirit and scope of the novel concepts claimed hereinbelow.

The invention is claimed as follows:

1. An index file comprising a support base, a table shiftably mounted on said base, index file support means carried by the table, base rail means carried by the base, complementary table rail means carried by the table, the base rail means and table rail means having identical cross-sectional shapes, antifriction ball means interposed between said base and table rail means, and a vertically extending brake lever depending from said support base and having a lower foot operative portion, said brake lever releasably locking the table in various positions of adjustment relative to the base.

2. An index file as set forth in claim 1, whereby said base and table rail means are interlocked together by said antifriction ball means.

3. An index file as set forth in claim 1, wherein said base and table rail means comprises a plurality of pairs of complementary rail members laterally separable to various positions of adjustment.

4. An index file as set forth in claim 1, wherein divider means is provided for sectionalizing the index file support means carried by the table.

5. An index file as set forth in claim 4, wherein said divider means comprises a channel longitudinally disposed on the top of the table, and shiftable divider members carried by the channel.

6. An index file as set forth in claim 5, wherein said divider members have a first position wherein said members may be shifted longitudinally of the channel, and a second position wherein said members are releasably locked to the channel.

7. An index file comprising a support base, rail means of a predetermined cross-sectional shape affixed to the support base, a table, rail means affixed to the table having a cross-sectional shape identical with the base rail cross-sectional shape and including a relatively depressed elongated outer channel formation, antifriction ball means interposed between said base rail and table rail, a vertically depending foot operated brake lever and brake pad means affixed to the brake lever for engaging the table rail depressed channel formation to releasably lock the table in various positions of lateral adjustment.

* * * * *